US009928810B2

(12) United States Patent
Harrington et al.

(10) Patent No.: US 9,928,810 B2
(45) Date of Patent: Mar. 27, 2018

(54) FONT CONTROL FOR ELECTRO-OPTIC DISPLAYS AND RELATED APPARATUS AND METHODS

(71) Applicant: E Ink Corporation, Billerica, MA (US)

(72) Inventors: Demetrious Mark Harrington, Dartmouth, MA (US); Alain Bouchard, Boston, MA (US); Matthew J. Aprea, Wellesley, MA (US); Kenneth R. Crounse, Somerville, MA (US)

(73) Assignee: E Ink Corporation, Billerica, MA (US)

( * ) Notice: Subject to any disclaimer, the term of this patent is extended or adjusted under 35 U.S.C. 154(b) by 132 days.

(21) Appl. No.: 15/010,980

(22) Filed: Jan. 29, 2016

(65) Prior Publication Data

US 2016/0314766 A1 Oct. 27, 2016

Related U.S. Application Data

(60) Provisional application No. 62/109,769, filed on Jan. 30, 2015.

(51) Int. Cl.

| | |
|---|---|
| ***G09G 5/10*** | (2006.01) |
| ***G09G 5/22*** | (2006.01) |
| ***G09G 3/34*** | (2006.01) |
| ***G09G 5/28*** | (2006.01) |

(52) U.S. Cl.

CPC ..... *G09G 5/227* (2013.01); *G09G 3/344* (2013.01); *G09G 3/3446* (2013.01); *G09G 5/22* (2013.01); *G09G 5/28* (2013.01); *G09G 2310/061* (2013.01); *G09G 2320/0257* (2013.01)

(58) Field of Classification Search

CPC ..... G09G 3/344; G09G 3/3446; G09G 5/22; G09G 5/28; G09G 5/277; G09G 2310/061; G09G 2320/0257

USPC ..... 345/690–692, 468, 207, 156, 467; 382/159, 161, 182; 715/810; 348/43

See application file for complete search history.

(56) References Cited

U.S. PATENT DOCUMENTS

| | | | | |
|---|---|---|---|---|
| 5,315,696 | A * | 5/1994 | Case | G09G 5/024 345/522 |
| 5,315,698 | A * | 5/1994 | Case | G09G 5/026 345/522 |
| 5,321,810 | A * | 6/1994 | Case | G09G 5/14 345/562 |
| 5,416,898 | A * | 5/1995 | Opstad | G06F 17/214 345/468 |
| 5,594,809 | A * | 1/1997 | Kopec | G06K 9/6297 382/161 |
| 5,760,761 | A | 6/1998 | Sheridon | |
| 5,777,782 | A | 7/1998 | Sheridon | |

(Continued)

OTHER PUBLICATIONS

Wood, D., "An Electrochromic Renaissance?" Information Display, 18(3), 24 (Mar. 2002) Mar. 1, 2002.

(Continued)

*Primary Examiner* — Prabodh M Dharia
(74) *Attorney, Agent, or Firm* — Brian D. Bean

(57) ABSTRACT

Methods are described for sequentially rendering fonts at multiple bit depths while reducing differences in visual appearance between the fonts rendered at different bit depths. The same hinting may be used for rendering the font at two different bit depths. Methods for reducing artifacts including edge artifacts also are described, including the use of font masks for updating electro-optic displays.

3 Claims, 8 Drawing Sheets

(56) References Cited

U.S. PATENT DOCUMENTS 5,808,783 A 9/1998 Crowley
5,864,711 A * 1/1999 Mairs ..... G06T 9/005 345/522
5,930,026 A 7/1999 Jacobson
6,054,071 A 4/2000 Mikkelsen, Jr.
6,055,091 A 4/2000 Sheridon
6,097,531 A 8/2000 Sheridon
6,128,124 A 10/2000 Silverman
6,137,467 A 10/2000 Sheridon
6,147,791 A 11/2000 Sheridon
6,157,750 A * 12/2000 Choi ..... G06T 3/0093 345/468
6,241,921 B1 6/2001 Jacobson
6,301,038 B1 10/2001 Fitzmaurice
6,445,489 B1 9/2002 Jacobson et al.
6,504,524 B1 1/2003 Gates
6,512,354 B2 1/2003 Jacobson
6,531,997 B1 3/2003 Gates
6,672,921 B1 1/2004 Liang et al.
6,753,999 B2 6/2004 Zehner
6,788,449 B2 9/2004 Liang
6,825,970 B2 11/2004 Goenaga
6,870,657 B1 3/2005 Fitzmaurice et al.
6,900,851 B2 5/2005 Morrison et al.
6,922,276 B2 7/2005 Zhang et al.
6,950,220 B2 9/2005 Abramson et al.
6,982,178 B2 1/2006 LeCain et al.
6,995,550 B2 2/2006 Jacobson
7,002,728 B2 2/2006 Pullen et al.
7,012,600 B2 3/2006 Zehner
7,023,420 B2 4/2006 Comiskey et al.
7,034,783 B2 4/2006 Gates
7,075,502 B1 7/2006 Drzaic
7,116,318 B2 10/2006 Amundson et al.
7,116,466 B2 10/2006 Whitesides et al.
7,119,772 B2 10/2006 Amundson
7,136,067 B2 * 11/2006 Stamm ..... G09G 5/28 345/467
7,170,670 B2 1/2007 Webber
7,193,625 B2 3/2007 Danner et al.
7,202,847 B2 4/2007 Gates
7,259,744 B2 8/2007 Arango
7,304,787 B2 12/2007 Whitesides et al.
7,312,784 B2 12/2007 Baucom et al.
7,312,794 B2 12/2007 Zehner
7,327,511 B2 2/2008 Whitesides et al.
7,411,719 B2 8/2008 Paolini, Jr. et al.
7,420,549 B2 9/2008 Jacobson
7,453,445 B2 11/2008 Amundson
7,492,339 B2 2/2009 Amundson
7,528,822 B2 5/2009 Amundson
7,535,624 B2 5/2009 Amundson et al.
7,545,358 B2 6/2009 Gates et al.
7,583,251 B2 9/2009 Arango
7,583,267 B2 9/2009 Stamm et al.
7,598,955 B1 10/2009 Dowling et al.
7,602,374 B2 10/2009 Zehner et al.
7,612,760 B2 11/2009 Kawai
7,679,599 B2 3/2010 Kawai
7,679,814 B2 3/2010 Paolini, Jr. et al.
7,688,297 B2 3/2010 Zehner et al.
7,729,039 B2 6/2010 LeCain et al.
7,733,311 B2 6/2010 Amundson
7,733,335 B2 6/2010 Zehner et al.
7,787,169 B2 8/2010 Abramson et al.
7,839,564 B2 11/2010 Whitesides et al.
7,868,888 B2 1/2011 Dowling et al.
7,952,557 B2 5/2011 Amundson et al.
7,956,841 B2 6/2011 Albert
7,999,787 B2 8/2011 Amundson
8,009,348 B2 8/2011 Zehner
8,077,141 B2 12/2011 Duthaler
8,125,501 B2 2/2012 Amundson
8,139,050 B2 3/2012 Jacobson et al.
8,174,490 B2 5/2012 Whitesides
8,289,250 B2 10/2012 Zehner
8,300,006 B2 10/2012 Zhou
8,305,341 B2 11/2012 Arango
8,314,784 B2 11/2012 Ohkami
8,319,759 B2 11/2012 Jacobson
8,384,658 B2 2/2013 Albert
8,558,783 B2 10/2013 Wilcox
8,558,785 B2 10/2013 Zehner
8,928,562 B2 1/2015 Gates et al.
9,230,492 B2 1/2016 Harrington
9,230,514 B1 * 1/2016 Bacus ..... G09G 5/24
2003/0102858 A1 6/2003 Jacobson et al.
2005/0067498 A1 * 3/2005 Smith ..... G06K 15/02 235/494
2005/0099649 A1 * 5/2005 Ferlitsch ..... H04N 1/00278 358/1.15
2005/0253777 A1 11/2005 Zehner et al.
2007/0091418 A1 4/2007 Danner et al.
2007/0103427 A1 5/2007 Zhou
2008/0024429 A1 1/2008 Zehner
2008/0024482 A1 1/2008 Gates
2008/0136774 A1 6/2008 Harris
2008/0291129 A1 11/2008 Harris
2009/0174651 A1 7/2009 Jacobson
2009/0179923 A1 7/2009 Amundson
2009/0195568 A1 8/2009 Sjodin
2009/0322721 A1 12/2009 Zehner
2010/0141670 A1 * 6/2010 Cohen ..... G09G 5/026 345/589
2010/0220121 A1 9/2010 Zehner
2010/0265561 A1 10/2010 Gates et al.
2010/0275161 A1 * 10/2010 DiCamillo ..... G06F 17/211 715/810
2010/0315431 A1 12/2010 Smith et al.
2011/0193840 A1 8/2011 Amundson
2011/0193841 A1 8/2011 Amundson
2011/0199671 A1 8/2011 Amundson
2012/0092454 A1 * 4/2012 Tourapis ..... H04N 13/0003 348/43
2012/0293858 A1 11/2012 Telfer
2013/0194250 A1 8/2013 Amundson
2014/0002428 A1 * 1/2014 Letourneur ..... G09G 3/34 345/207
2014/0218388 A1 * 8/2014 Higgins ..... G09G 3/2003 345/592
2015/0131126 A1 * 5/2015 Daniels ..... G06F 3/1256 358/2.1
2015/0262347 A1 * 9/2015 Duerksen ..... G06T 7/0002 382/182
2016/0104457 A1 * 4/2016 Wu ..... G09G 5/39 345/522
2016/0110905 A1 * 4/2016 Kurzweil ..... G06T 11/60 345/636

OTHER PUBLICATIONS

O'Regan, B. et al., "A Low Cost, High-efficiency Solar Cell Based on Dye-sensitized colloidal TiO2 Films", Nature, vol. 353, Oct. 24, 1991, 773-740 Oct. 24, 1991.

Bach, U., et al., "Nanomaterials-Based Electrochromics for Paper-Quality Displays", Adv. Mater, 14(11), 845 (2002) Jun. 5, 2002.

Hayes, R.A., et al., "Video-Speed Electronic Paper Based on Electrowetting", Nature, vol. 425, Sep. 25, pp. 383-385 (2003) Sep. 25, 2003.

* cited by examiner

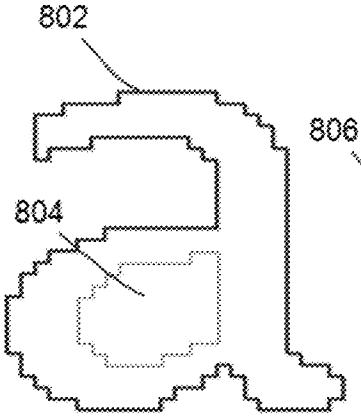
FIG. 8A
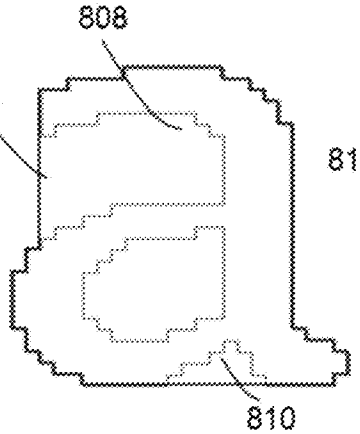
FIG. 8B
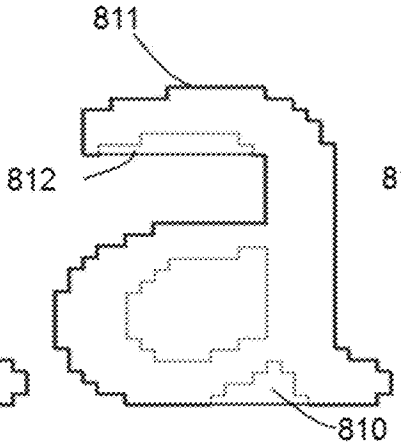
FIG. 8C
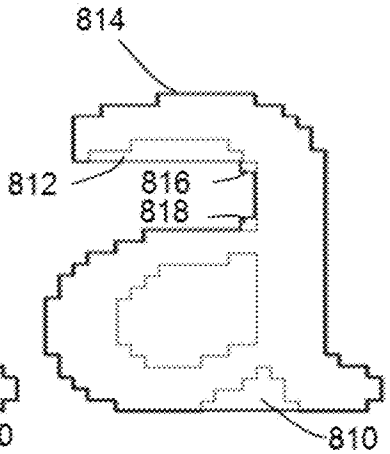
FIG. 8D
FIG. 8E
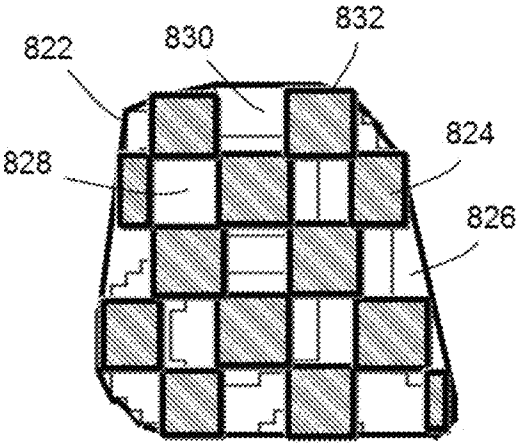
FIG. 8F
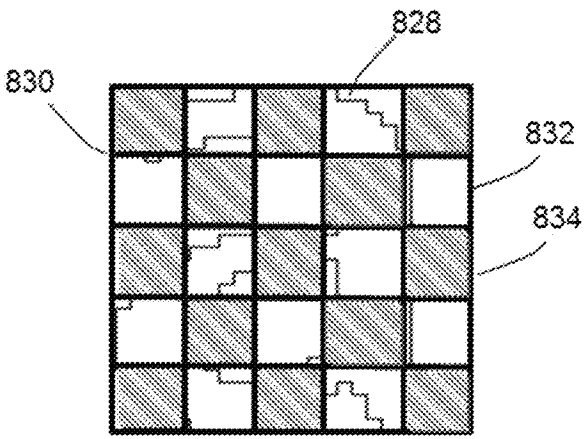
FIG. 8G

FONT CONTROL FOR ELECTRO-OPTIC DISPLAYS AND RELATED APPARATUS AND METHODS

REFERENCE TO RELATED APPLICATIONS

This application claims benefit of U.S. Provisional Application Ser. No. 62/100,769 filed on Jan. 30, 2015. The entire contents of this and all other U.S. patents and published and applications mentioned below are herein incorporated by reference.

BACKGROUND OF INVENTION

The present application relates to electro-optic displays, with some aspects relating more specifically to control of such displays when using glyphs to display text, characters, and symbols, etc.

SUMMARY OF INVENTION

Aspects of the present application provide methods for displaying text, characters or symbols, etc. on an electro-optic display in two or more bit depths with little or no variation between hinting. In some embodiments, the same hinting is used to display the same text sequentially at two different bit depths.

According to an aspect of the present application, a method is provided for driving a display, the method comprising displaying on a display, at a first bit depth, textual information, characters or symbols in a font using at least one font hint, and subsequent to displaying the textual information at the first bit depth, displaying the textual information on the display at a second bit depth in the font using the at least one font hint.

According to another aspect of the present application, a method is provided for updating an electro-optic display in a manner that reduces artifacts without increasing flashiness of the display. In some embodiments, a pixel mask is used defining a greater number of pixels to be updated than are included in a glyph being updated.

According to an aspect of the present application, a method of driving a display is provided, the method comprising, for a glyph displayed on the display and occupying a first number of pixels of the display, flashing a second number of pixels of the display encompassing the glyph where the second number of pixels is greater than the first number of pixels. The subset of pixels of the display is less than or equal to a convex hull encompassing the glyph in some embodiments.

BRIEF DESCRIPTION OF DRAWINGS

Various aspects and embodiments of the application will be described with reference to the following figures. It should be appreciated that the figures are not necessarily drawn to scale. Items appearing in multiple figures are indicated by the same reference number in all the figures in which they appear.

FIGS. 8A-G are example masks that may be applied to the example glyph in FIG. 7A when updating the display, according to non-limiting embodiments of the present application.

DETAILED DESCRIPTION

Figure 1:
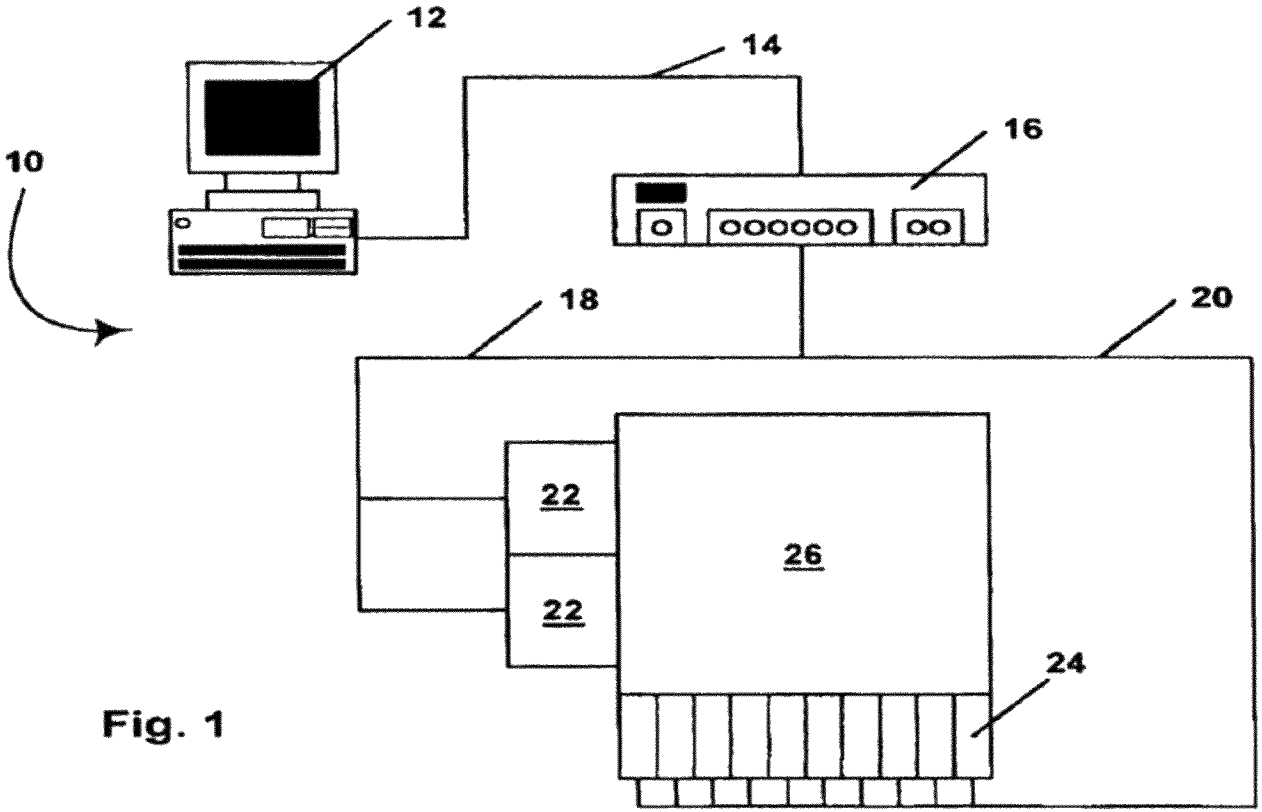
FIG. 1 is a schematic representation of an apparatus with an associated display according to a non-limiting embodiment of the present application.

Aspects of the present application provide methods for displaying text, characters or symbols, etc. on an electro-optic display in two or more bit depths with little or no variation between hinting. Another aspect of the present application provides for a method of displaying a glyph having a first number of pixels, then removing the glyph by flashing a second number of pixels of the display encompassing the glyph where the second number of pixels is greater than the first number of pixels.

The term "electro-optic", as applied to a material or a display, is used herein in its conventional meaning in the imaging art to refer to a material having first and second display states differing in at least one optical property, the material being changed from its first to its second display state by application of an electric field to the material. Although the optical property is typically color perceptible to the human eye, it may be another optical property, such as optical transmission, reflectance, luminescence or, in the case of displays intended for machine reading, pseudo-color in the sense of a change in reflectance of electromagnetic wavelengths outside the visible range.

The term "gray state" is used herein in its conventional meaning in the imaging art to refer to a state intermediate two extreme optical states of a pixel, and does not necessarily imply a black-white transition between these two extreme states. For example, an electrophoretic display may have extreme states that are white and deep blue, so that an intermediate "gray state" would actually be pale blue. Indeed, as already mentioned, the change in optical state may not be a color change at all. The terms "black" and "white" may be used hereinafter to refer to the two extreme optical states of a display, and should be understood as normally including extreme optical states which are not strictly black and white, for example the aforementioned white and dark blue states. The term "monochrome" may be used hereinafter to denote a drive scheme which only drives pixels to their two extreme optical states with no intervening gray states.

Some electro-optic materials are solid in the sense that the materials have solid external surfaces, although the materials may, and often do, have internal liquid- or gas-filled spaces. Such displays using solid electro-optic materials may hereinafter for convenience be referred to as "solid electro-optic displays". Thus, the term "solid electro-optic displays" includes rotating bichromal member displays, encapsulated electrophoretic displays, microcell electrophoretic displays and encapsulated liquid crystal displays.

The terms "bistable" and "bistability" are used herein in their conventional meaning in the art to refer to displays comprising display elements having first and second display states differing in at least one optical property, and such that after any given element has been driven, by means of an addressing pulse of finite duration, to assume either its first or second display state, after the addressing pulse has terminated, that state will persist for at least several times, for example at least four times, the minimum duration of the addressing pulse required to change the state of the display element. It is shown in U.S. Pat. No. 7,170,670 that some particle-based electrophoretic displays capable of gray scale are stable not only in their extreme black and white states but also in their intermediate gray states, and the same is true of some other types of electro-optic displays. This type of display is properly called "multi-stable" rather than bistable, although for convenience the term "bistable" may be used herein to cover both bistable and multi-stable displays.

Several types of electro-optic displays are known. One type of electro-optic display is a rotating bichromal member type as described, for example, in U.S. Pat. Nos. 5,808,783; 5,777,782; 5,760,761; 6,054,071 6,055,091; 6,097,531; 6,128,124; 6,137,467; and 6,147,791 (although this type of display is often referred to as a "rotating bichromal ball" display, the term "rotating bichromal member" is preferred as more accurate since in some of the patents mentioned above the rotating members are not spherical). Such a display uses a large number of small bodies (typically spherical or cylindrical) which have two or more sections with differing optical characteristics, and an internal dipole. These bodies are suspended within liquid-filled vacuoles within a matrix, the vacuoles being filled with liquid so that the bodies are free to rotate. The appearance of the display is changed by applying an electric field thereto, thus rotating the bodies to various positions and varying which of the sections of the bodies is seen through a viewing surface. This type of electro-optic medium is typically bistable.

Another type of electro-optic display uses an electrochromic medium, for example an electrochromic medium in the form of a nanochromic film comprising an electrode formed at least in part from a semi-conducting metal oxide and a plurality of dye molecules capable of reversible color change attached to the electrode; see, for example O'Regan, B., et al., Nature 1991, 353, 737; and Wood, D., Information Display, 18(3), 24 (March 2002). See also Bach, U., et al., Adv. Mater., 2002, 14(11), 845. Nanochromic films of this type are also described, for example, in U.S. Pat. Nos. 6,301,038; 6,870,657; and 6,950,220. This type of medium is also typically bistable.

Another type of electro-optic display is an electro-wetting display developed by Philips and described in Hayes, R. A., et al., "Video-Speed Electronic Paper Based on Electrowetting", Nature, 425, 383-385 (2003). It is shown in U.S. Pat. No. 7,420,549 that such electro-wetting displays can be made bistable.

One type of electro-optic display, which has been the subject of intense research and development for a number of years, is the particle-based electrophoretic display, in which a plurality of charged particles move through a fluid under the influence of an electric field. Electrophoretic displays can have attributes of good brightness and contrast, wide viewing angles, state bistability, and low power consumption when compared with liquid crystal displays. Nevertheless, problems with the long-term image quality of these displays have prevented their widespread usage. For example, particles that make up electrophoretic displays tend to settle, resulting in inadequate service-life for these displays.

Numerous patents and applications assigned to or in the names of the Massachusetts Institute of Technology (MIT) and E Ink Corporation describe various technologies used in encapsulated electrophoretic and other electro-optic media. Such encapsulated media comprise numerous small capsules, each of which itself comprises an internal phase containing electrophoretically-mobile particles in a fluid medium, and a capsule wall surrounding the internal phase. Typically, the capsules are themselves held within a polymeric binder to form a coherent layer positioned between two electrodes. The technologies described in these patents and applications include:

(a) Electrophoretic particles, fluids and fluid additives; see for example U.S. Pat. Nos. 7,002,728 and 7,679,814;

(b) Capsules, binders and encapsulation processes; see for example U.S. Pat. Nos. 6,922,276 and 7,411,719;

(c) Films and sub-assemblies containing electro-optic materials; see for example U.S. Pat. Nos. 6,982,178 and 7,839,564;

(d) Backplanes, adhesive layers and other auxiliary layers and methods used in displays; see for example U.S. Pat. Nos. 7,116,318 and 7,535,624;

(e) Color formation and color adjustment; see for example U.S. Pat. No. 7,075,502 and U.S. Patent Application Publication No. 2007/0109219;

(f) Methods for driving displays; see for example U.S. Pat. Nos. 5,930,026; 6,445,489; 6,504,524; 6,512,354; 6,531,997; 6,753,999; 6,825,970; 6,900,851; 6,995,550; 7,012,600; 7,023,420; 7,034,783; 7,116,466; 7,119,772; 7,193,625; 7,202,847; 7,259,744; 7,304,787; 7,312,794; 7,327,511; 7,453,445; 7,492,339; 7,528,822; 7,545,358; 7,583,251; 7,602,374; 7,612,760; 7,679,599; 7,688,297; 7,729,039; 7,733,311; 7,733,335; 7,787,169; 7,952,557; 7,956,841; 7,999,787; 8,077,141; 8,125,501; 8,139,050; 8,174,490; 8,289,250; 8,300,006; 8,305,341; 8,314,784; 8,384,658; 8,558,783; and 8,558,785; and U.S. Patent Applications Publication Nos. 2003/0102858; 2005/0122284; 2005/0253777; 2007/0091418; 2007/0103427; 2008/0024429; 2008/0024482; 2008/0136774; 2008/0291129; 2009/0174651; 2009/0179923; 2009/0195568; 2009/0322721; 2010/0220121; 2010/0265561; 2011/0193840; 2011/0193841; 2011/0199671; 2011/0285754; and 2013/0194250;

(g) Applications of displays; see for example U.S. Pat. Nos. 7,312,784 and 8,009,348; and (h) Non-electrophoretic displays, as described in U.S. Pat. Nos. 6,241,921; 6,950,220; 7,420,549 and 8,319,759; and U.S. Patent Application Publication No. 2012/0293858.

Another type of electrophoretic display is a so-called "microcell electrophoretic display". In a microcell electrophoretic display, the charged particles and the fluid are not encapsulated within microcapsules but instead are retained within a plurality of cavities formed within a carrier medium, typically a polymeric film. See, for example, U.S. Pat. Nos. 6,672,921 and 6,788,449, both assigned to Sipix Imaging, Inc.

Other types of electro-optic materials may also be used in aspects of the present application. Of particular interest, bistable ferroelectric liquid crystal displays (FLC's) are known in the art An electro-optic display normally comprises a layer of electro-optic material and at least two other layers disposed on opposed sides of the electro-optic material, one of these two layers being an electrode layer. In most such displays both the layers are electrode layers, and one or both of the electrode layers are patterned to define the pixels of the display. For example, one electrode layer may be patterned into elongate row electrodes and the other into elongate column electrodes running at right angles to the row electrodes, the pixels being defined by the intersections of the row and column electrodes. Alternatively, and more commonly, one electrode layer has the form of a single continuous electrode and the other electrode layer is patterned into a matrix of pixel electrodes, each of which defines one pixel of the display. In another type of electro-optic display, which is intended for use with a stylus, print head or similar movable electrode separate from the display, only one of the layers adjacent the electro-optic layer comprises an electrode, the layer on the opposed side of the electro-optic layer typically being a protective layer intended to prevent the movable electrode damaging the electro-optic layer.

The term L star may be used herein, and may be represented by "L*". L* has the usual CIE definition: L*=116 (R/R0)1/3−16, where R is the reflectance and R0 is a standard reflectance value.

The term "impulse" is used herein in its conventional meaning of the integral of voltage with respect to time. However, some bistable electro-optic media act as charge transducers, and with such media an alternative definition of impulse, namely the integral of current over time (which is equal to the total charge applied) may be used. The appropriate definition of impulse should be used, depending on whether the medium acts as a voltage-time impulse transducer or a charge impulse transducer.

A complication in driving electrophoretic displays is the need for so-called "DC balance". As discussed in U.S. Pat. Nos. 6,531,997 and 6,504,524, problems may be encountered, and the working lifetime of a display reduced, if the method used to drive the display does not result in zero, or near zero, net time-averaged applied electric field across the electro-optic medium. A drive method which does result in zero net time-averaged applied electric field across the electro-optic medium is conveniently referred to a "direct current balanced" or "DC balanced".

As already noted, an encapsulated electrophoretic medium typically comprises electrophoretic capsules disposed in a polymeric binder, which serves to form the discrete capsules into a coherent layer. The continuous phase in a polymer-dispersed electrophoretic medium, and the cell walls of a microcell medium serve similar functions. It has been found by E Ink researchers that the specific material used as the binder in an electrophoretic medium can affect the electro-optic properties of the medium. Among the electro-optic properties of an electrophoretic medium affected by the choice of binder is the so-called "dwell time dependence," discussed in U.S. Pat. No. 7,119,772 (see especially FIG. 34 and the related description). It has been found that, at least in some cases, the impulse necessary for a transition between two specific optical states of a bistable electrophoretic display varies with the residence time of a pixel in its initial optical state, and this phenomenon is referred to as "dwell time dependence" or "DTD". Obviously, it is desirable to keep DTD as small as possible since DTD affects the difficulty of driving the display and may affect the quality of the image produced; for example, DTD may cause pixels which are supposed to form an area of uniform gray color to differ slightly from one another in gray level, and the human eye is very sensitive to such variations. Although it has been known that the choice of binder affects DTD, choosing an appropriate binder for any specific electrophoretic medium has hitherto been based on trial-and-error, with essentially no understanding of the relationship between DTD and the chemical nature of the binder.

Some of the discussion below will focus on methods for driving one or more pixels of an electro-optic display through a transition from an initial gray level to a final gray level (which may or may not be different from the initial gray level). The term "waveform" will be used to denote the entire voltage against time curve used to effect the transition from one specific initial gray level to a specific final gray level. Typically such a waveform will comprise a plurality of waveform elements; where these elements are essentially rectangular (i.e., where a given element comprises application of a constant voltage for a period of time); the elements may be called "pulses" or "drive pulses". The term "drive scheme" denotes a set of waveforms sufficient to effect all possible transitions between gray levels for a specific display. A display may make use of more than one drive scheme; for example, U.S. Pat. No. 7,012,600 teaches that a drive scheme may need to be modified depending upon parameters such as the temperature of the display or the time for which it has been in operation during its lifetime, and thus a display may be provided with a plurality of different drive schemes to be used at differing temperature etc. A set of drive schemes used in this manner may be referred to as "a set of related drive schemes." It is also possible to use more than one drive scheme simultaneously in different areas of the same display, and a set of drive schemes used in this manner may be referred to as "a set of simultaneous drive schemes."

The inventors have appreciated that when displaying text on electro-optic displays, among others, there is sometimes a compromise between the time it takes to display the text and the quality of the text displayed, both of which can depend on the bit depth used for the text. Text displayed with a lower bit depth may appear more pixelated than the same text displayed with a higher bit depth. However, more time may be needed to drive the display when a higher bit depth is used. The bit depth selected for displaying text may depend on preferences for the overall user experience. For example, when text is displayed quickly, such as when flipping among pages on an electronic display, such as when using an e-reader, the text may be displayed in 1-bit (black and white) depth. When the text is displayed with a better quality, more time is needed to display the text to a higher bit depth, such as a 4-bit gray scale. Thus, one approach for displaying text in the context in which a user expects high speed and high quality is to initially display the text in a low bit depth (e.g., 1-bit depth) and then update the same text to a higher quality bit depth (e.g., 4-bit depth) to provide better viewing of the text.

However, the inventors have recognized that standard font rendering algorithms produce inconsistencies between a high bit depth text and a low bit depth text displayed in the same font. For example, the size of a text character or glyph may change between two different bit depths. As a result, if a page of text displayed in one bit depth is changed to a different bit depth, the location of the glyphs that make up the text may change to accommodate this change in size due to the different bit depth. Additional font elements, such as stems and serifs, may be dictated by, or even removed or reduced by, font instructions or font hints. Inconsistencies may arise because the font hinting to display glyphs differs between lower and higher bit depths.

Thus, aspects of the present application disclose techniques to render fonts at different bit depths where inconsistencies between characteristics, such as the font hinting at different bit depths, are reduced or eliminated entirely. In some embodiments, the same font hints are used for more than one bit depth. Using such techniques, text displayed on a display (e.g., an electrophoretic display) may be displayed quickly with a low bit depth and changed to a higher bit depth without noticeable change in the text, which may improve user experience.

Additionally, the inventors have recognized that changing the text displayed on some electronic displays, such as on an electro-optic display, may produce artifacts as pixels change from one pixel color or value to another. Text on the display is a series of characters or glyphs. A portion of the pixels on the display are driven to a non-white pixel value to display each glyph, often gray or black, although other colors are possible. When text is changed on the display, such as changing to another page (for instance, on an e-reader), some of the pixels displaying the glyphs may change value to display the new text. The white pixels adjacent to the non-white pixels (e.g., black and/or gray pixels) may produce artifacts when the new text is displayed. Such artifacts may include edge ghosting where the edges of previous text glyphs remain on the display. Such artifacts may accumulate over time as the display undergoes repeated text updates.

Previous techniques to reduce the presence of edge ghosting include a global updating of all the pixels on the display to a same pixel value, such as white, before displaying new text. In some situations, multiple global updates are performed to ensure removal of artifacts. However, such a global update technique produces a flashing display which may be undesirable to readers. Flashiness may result from actively driving all pixels or a subset of pixels to a same pixel value or may result from actively driving all pixels or a subset of pixels to a next image. As used herein, the term actively driving a pixel to a value (i.e., gray level) does not include null transitions or zero voltage transitions.

Aspects of the present application provide techniques to both reduce the presence of edge ghosting and reduce the flashiness of the display. Such techniques include defining a region of pixels that includes the pixels in the glyph and some pixels adjacent to the glyph to be changed to white before updating the entire display to new text. The region of the pixels in the glyph and the pixels adjacent to the glyph may be called a mask. By using such a mask, the number of white-black and/or white-gray boundaries are reduced and updating the pixels within the mask may reduce the presence of edge ghosting. Using such a mask may reduce the appearance of flashiness because only a portion of the pixels are brought to white but still maintains a level of accuracy in the displayed text.

The aspects and embodiments described above, as well as additional aspects and embodiments, are described further below. These aspects and/or embodiments may be used individually, all together, or in any combination of two or more, as the application is not limited in this respect.

Aspects of the present application relate to methods and apparatus for driving a display with electro-optic media which are sensitive to the polarity of electric field applied. Such a display may include any suitable electro-optic display, including electrophoretic displays, rotating bichromal member displays, and devices that have such electro-optic displays, such as e-readers and e-paper. An example apparatus that may use aspects of the present application is shown in FIG. 1. The overall example apparatus 10 may include an image source, shown as a personal computer 12, which may output on a data line 14 data representing an image. The data line may extend to a controller unit 16. The controller unit 16 may generate one set of output signals on a data bus 18 and a second set of signals on a separate data bus 20. The data bus 18 may be connected to row (or gate) drivers 22, while the data bus 20 is connected to a plurality of column (or source) drivers 24. The row and column drivers control the operation of a bistable electro-optic display 26.

Figure 2:
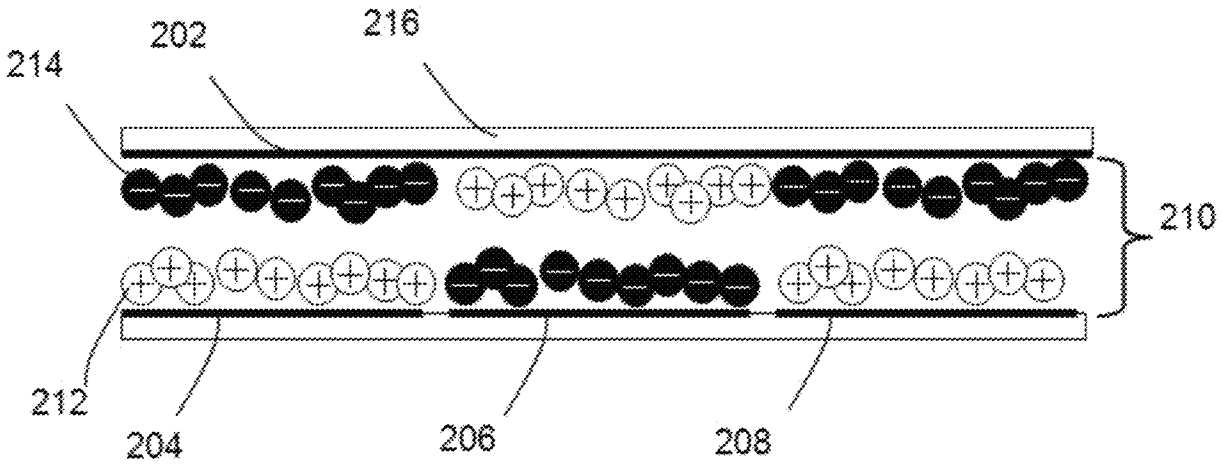
FIG. 2 is a cross-sectional diagram of an example of an electrophoretic display.

A cross-sectional view of an example display architecture (e.g., of electro-optic display 26) is shown in FIG. 2. The display architecture may include a single common transparent electrode 202 on one side of the electro-optic layer 210, this common electrode 202 extending across all the pixels on the display. This common electrode 202 lies between the electro-optic layer 210 and the observer and forms a viewing surface 216 through which an observer views the display. On the opposite side of the electro-optic layer is disposed a matrix of pixel electrodes arranged in rows and columns such that each pixel electrode is uniquely defined by the intersection of a single row and a single column. Although only three pixels 204, 206, and 208 are shown in FIG. 2, any suitable number of pixels may be used for such an electro-optic display. Additionally or alternatively, the arrangement of the common electrode and pixels may be reversed. The electric field experienced by each pixel of the electro-optic layer is controlled by the varying voltage applied to the associated pixel electrode relative to the voltage applied to the common electrode.

The electro-optic layer may include any suitable electro-optic media. In the example shown in FIG. 2, the electro-optic media includes positively charged white particles 212 and negatively charge black particles 214. The applied electric field on a pixel may alter the pixel value for a certain pixel by positioning particles 212 and 214 within the space between the common electrode and pixel electrode such that the particles closer to the viewing surface 216 determine the pixel value. The pixels in the example display shown in FIG. 2 are either in a black state, pixels 204 and 208, or white state, pixel 206, and the information on such a display may be referred to as a 1-bit depth. A gray state or pixel value may be formed by applying a voltage signal to create a mixture of black and white particles visible by an observer through the viewing surface.

Figure 3:
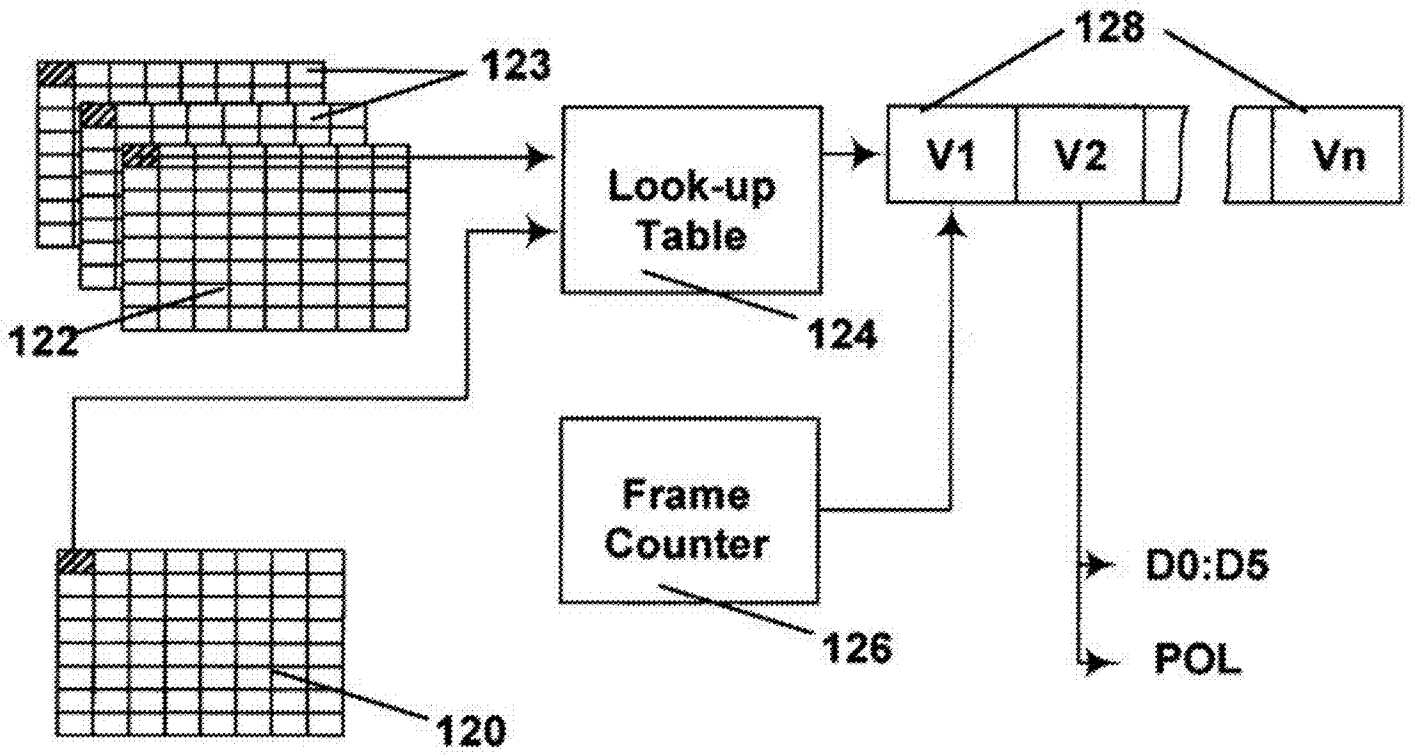
FIG. 3 is a schematic block diagram showing a manner in which the controller unit shown in FIG. 1 may generate certain output signals.

Any suitable method and apparatus for driving the voltage signals applied to the pixel electrodes and common electrode may be used. FIG. 3 illustrates the manner in which an example controller 16 of FIG. 1 generates voltage signals. Voltage signals may include bit voltage value for a pixel, such as D0:D5 for six-bit voltage signals, and a polarity signal POL with respect to the common electrode 202. Although six-bit voltage signals are output for the example controller in FIG. 3, any suitable number of bit voltage signals may be used to form a bit depth. The controller stores data representing the final image 120 (the image which it is desired to write to the display), the initial image 122 previously written to the display, and optionally one or more prior images 123 which were written to the display before the initial image. The controller uses the data for a specific pixel in the initial, final, and prior images 120, 122, and 123, as pointers into a look-up table 124, which provides the value of the impulse which must be applied to the specific pixel to change the state of that pixel to the desired gray level in the final image. The resultant output from the look-up table 124, and the output from a frame counter 126, are supplied to a voltage versus frame array 128, which generates control voltage signals. Driving of bistable electro-optic displays using look-up tables is described in more detail in the aforementioned U.S. Pat. No. 7,012,600.

Figure 4:
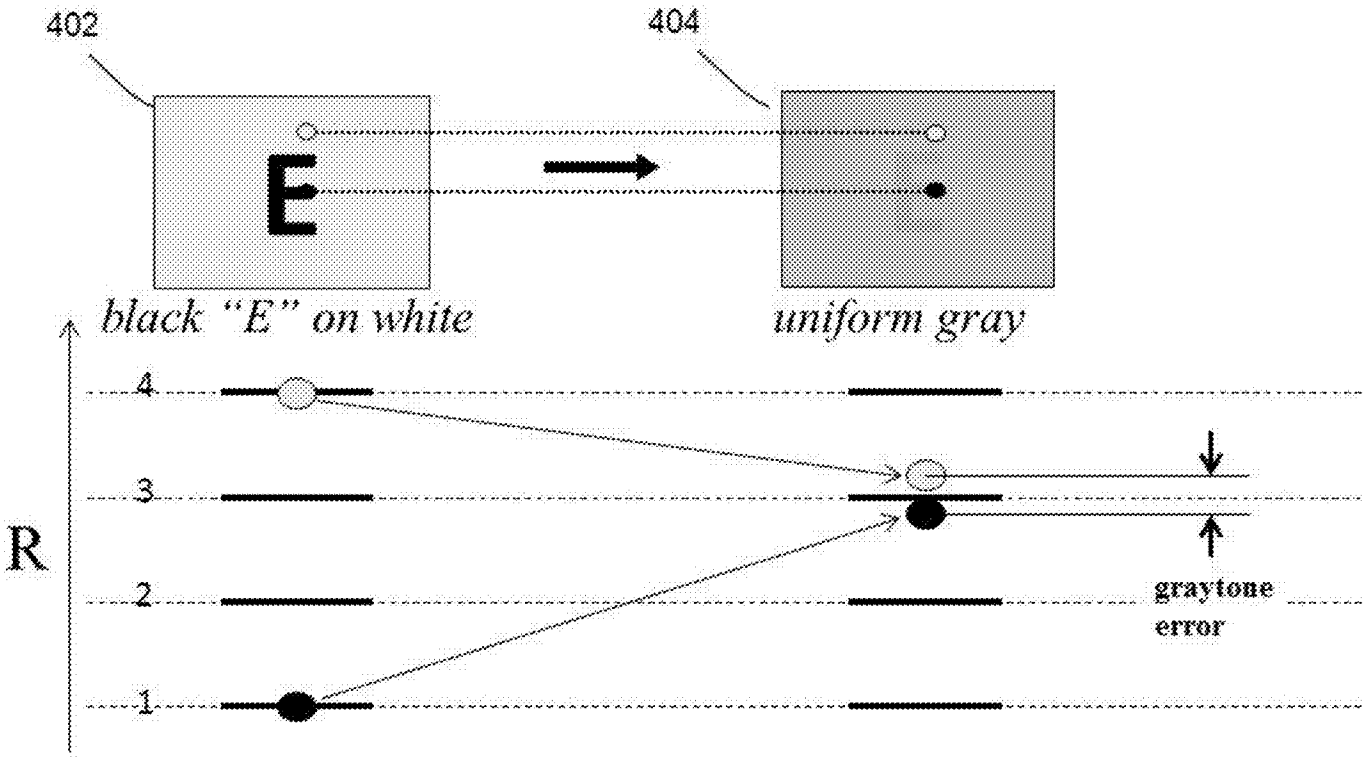
FIG. 4 is a schematic illustrating how a previous state of a display pixel can influence a current pixel value.

As previously described, when the pixel value for a pixel is changed to a different value, a previously applied voltage of the pixel or pixel value may influence the current pixel value. FIG. 4 shows an example of a black "E" on a white background on an example display in image 402 where pixels in the "E" are black and have a value of "1" and pixels outside of the "E" are white and have a value of "4."

However, when the display is subsequently driven to form a uniform gray background, image 404, the previously black pixels that formed the letter "E" have a different pixel value than the previously white pixels of the background. Such a difference in pixel values may be called a graytone error and may produce artifacts in the displayed information or text on the display, such as ghosting and edge artifacts where parts of the previous image are still apparent in a current image. Previous techniques for reducing such artifacts may include applying voltage waveforms for a longer period of time and flashing to clear ghosting effects. The present application includes techniques for improving the time of rendering text and reducing artifacts in the text that is ultimately displayed.

Techniques for improving (e.g., increasing) the time of displaying text may include displaying the text quickly with a low bit depth and changing to a higher bit depth without noticeable change in the text. A computer font includes a font data file with outlines and hints to be used when displaying glyphs on a display. Specific instructions or hints may remain consistent among different bit depths, allowing for text to be displayed in a consistent manner between different bit depths. These hints may include size, kerning, stem thickness, arm thickness, glyph spacing, glyph width, glyph height, ascender length, descender length, and serif thickness. Such hints may be made consistent among text displayed in a low-bit depth and a high-bit depth in order to reduce inconsistencies among different bit depths, according to an aspect of the present application.

Figure 5:
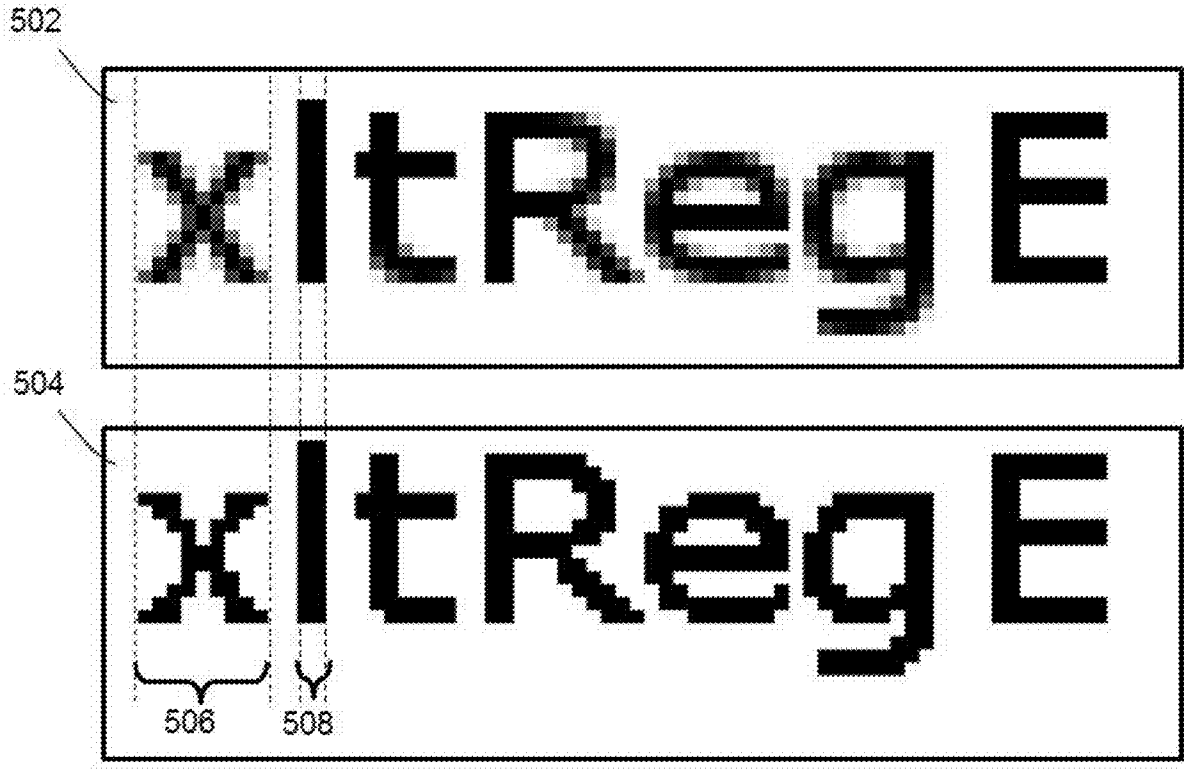
FIG. 5 illustrates example glyphs in a sans serif font for both a multi-bit and a 1-bit font depth.
Figure 6:
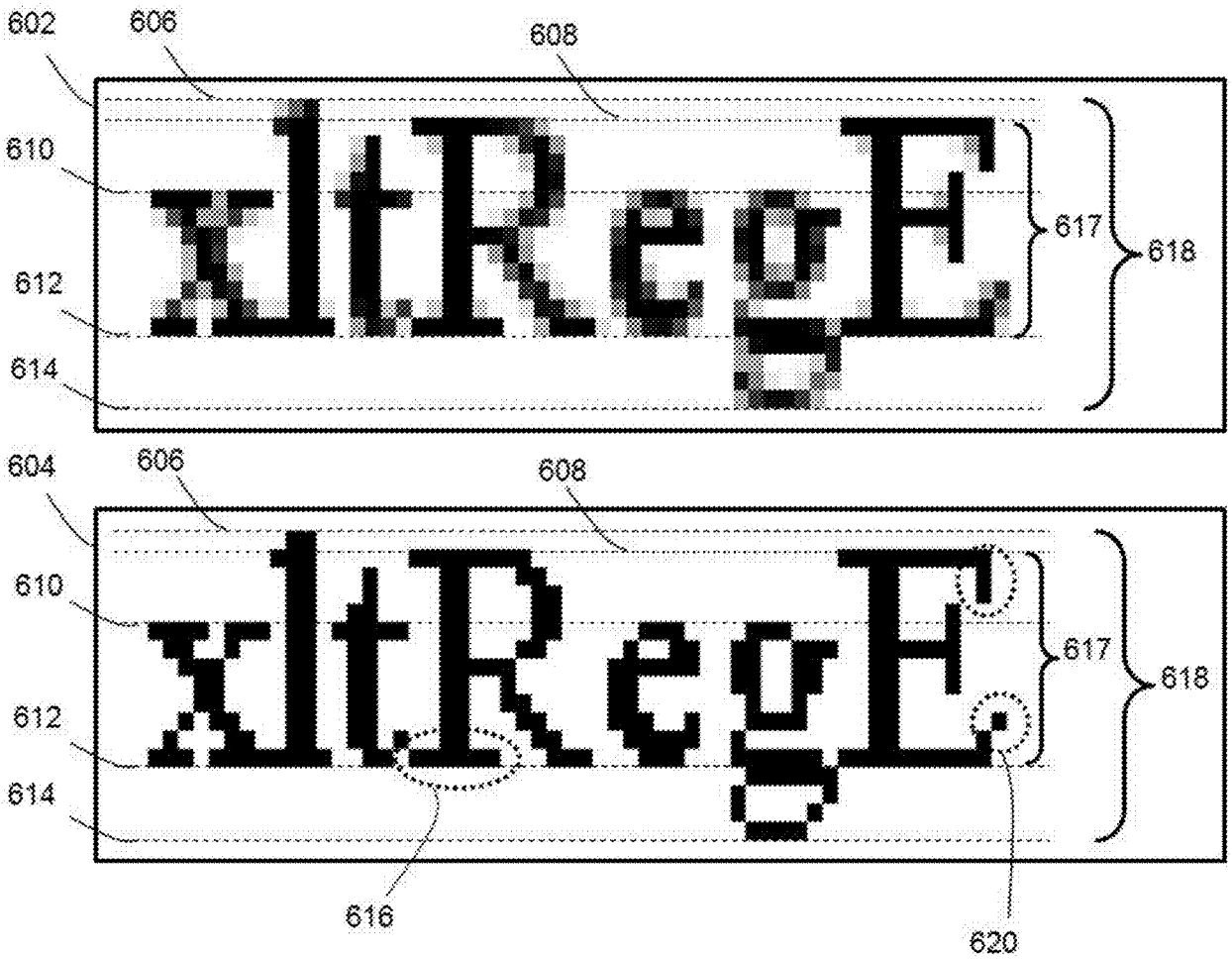
FIG. 6 illustrates example glyphs in a serif font for both a multi-bit and a 1-bit font depth.

Examples of glyphs where consistent font hinting is applied to 1-bit (e.g. A2) and multi-bit depth (e.g. GC16) are shown in FIGS. 5 and 6. Consistent characteristics of the fonts between the different bit-depths improve overall text quality and may be used to improve user experience. The 1-bit depth may be used to quickly display glyphs (e.g., for a fast update) while the multi-bit depth may be used to display with a standard update. In some embodiments, text in a 1-bit depth may be displayed first before the text is updated to a multi-bit depth. As previously described, it is desirable to minimize or eliminate differences in hinting between different depths to improve user viewing experience.

An example sans serif font for both multi-bit font depth text 502 and 1-bit font depth text 504 is shown in FIG. 5. A glyph in 1-bit depth text 504 has the same width in multi-bit 502, as indicated by width 506 for letter "x" and 508 for letter "1." Additionally, glyph stems and arms have the same thickness between 502 and 504.

An example serif font (Times New Roman) for both a multi-bit font depth 602 and a 1-bit font depth 604 are shown in FIG. 6. An example serif in the letter "R" is indicated by 616. For defining features in a font, x line 610 is used for reference in comparison with other feature lines for the font. Base line 612 refers to the line on which characters rest, marking the bottom of most letters. X-height refers the height of the lower case letters above the baseline. Cap line 608 designates the height of capital letters from the base line 612, with the height of the capital letters being 617. Descender line 614 refers to the distance that characters extend below the baseline for some glyphs (e.g. p, g, j). Ascender line 606 refers to the top of ascending characters and the distance that ascenders extend above the x-height is set by the ascender line. The location of descender and ascender lines may vary with font. Font height 618 refers to the height of the font from the descender line 614 to ascender line 606. As shown in FIG. 6, the glyph heights 618, ascender line 606, descender line 614, and serif 616 may be the same for both the 1-bit depth text 604 and multi-bit depth text 602. Additionally, the kerning, or space between glyphs, may be the same for different bit-depths. In some embodiments, features of certain glyphs, including disconnected pixels such as region 620 of the letter "E," may be removed in order to improve overall quality of the rendered text.

In some embodiments, a technique for implementing the font pairs as rendered above in FIGS. 5 and 6 without differences in hinting between the different bit depths may include rendering font in one bit depth by using hints from a different bit depth. A font renderer may read a font file and display text using embedded hints or instructions in the font file for one bit depth and, if the text is updated to a different bit depth, the same hints or instructions are used to display the text in the different bit depth, in contrast to using unique hints for each bit depth. As an example, a renderer may display text using a 1-bit depth using embedded hints for the 1-bit depth and when the text is converted to a multi-bit depth, the same hints from the 1-bit version are used.

In some embodiments, font hints may be specifically designed and/or selected for more than one bit-depth in order to reduce inconsistencies among different bit depths. Such designed hints may be selected from pre-existing hints used in a font file for a particular font or bit-depth and/or may be uniquely designed. The designed font hints may be used to render text in a font at different bit depths.

In some embodiments, a thresholding algorithm may be applied to render a font for multiple bit depths. Displaying text in a 1-bit depth font may include rendering the text at a multi-bit depth and applying a thresholding algorithm to convert the multi-bit depth text to 1-bit depth text. Such a thresholding algorithm may include applying a threshold value to multi-bit depth text and pixels that form the text are converted to 1-bit values based on the threshold value. For an example, pixel values above the threshold value are converted to white pixels while pixels below the threshold value are converted to black pixels to render the text in 1-bit depth.

In some embodiments, different waveforms or voltage signals may be used to render text for multiple bit depths. The waveforms may be designed for speed of displaying the text on the display and/or quality of the rendered text. As an example, one waveform may render text quickly, but the text may have poor quality, and another waveform may render text over a longer period of time with higher quality. Thus, various techniques may be used to render text in different bit depths while reducing differences in appearance.

The present application also includes techniques for reducing artifacts when text is updated to new information while reducing the flashiness of the display. An update mask may be applied to each rendered glyph for a particular font. The mask may include pixels other than the pixels in the rendered glyph. The additional pixels may be pixels adjacent to the pixels in the glyph. When text information is updated on a display, pixels within the mask may be updated to a pixel value, such as white, before or during the display of new text. Areas outside the update mask, i.e., background pixels, will likely transition from white to white, such that they may not flash and, since they are transitioning from white to white, may not be updated. The update mask may be created in any suitable manner, such as through an algorithm or by a user. The update mask may be created while the font is being rendered, as part of the rendering process, and/or after the font is rendered on a display.

A mask may be formed for a particular glyph based on reducing overall flashiness and/or improving quality of the displayed text. The mask may reduce the number of edges in the updated area to reduce overall edge artifacts. The mask may also fill in enclosed areas within glyphs and/or fill in areas outside glyphs but, for example, within the convex hull. The convex hull of a set X of points in the Euclidean space or plane is the smallest convex set that contains X. When X is a bounded subset of the plane, the convex hull may be visualized as the shape formed by a rubber band stretched around X. This may be referred to as the convex envelope. More formally, the convex hull may be defined as the intersection of all convex sets containing X or as the set of all convex combinations of points in X. In some instances, the length of the edges may be considered and a mask may be designed to reduce continuous straight edges in order to minimize the visibility of edge artifacts. Since there is some increase in flashiness of the overall screen by including pixels outside the bounds of a pixelated glyph in the update, the mask may be optimized to account for a balance of flashiness and edge reduction level. An update mask may be formed based on an edge reduction level where the edge reduction level may be determined based on the total edges in the mask and the number of pixels in the mask that are updated. Such an edge reduction level for a particular mask may be determined from a ratio of the difference between the number of edges in a pixelated glyph and the mask to the difference between the number of pixels in the mask and the pixelated glyph. Additionally or alternatively, the corner where two edges meet may show stronger ghosting than other areas, and a mask may be chosen to minimize the amount of corners for the updated area. In some embodiments, a mask may include areas of consecutive characters and may be defined by how certain glyphs are connected to each other.

Figure 7B:
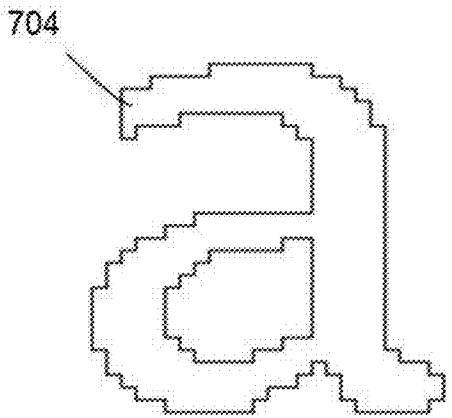
FIG. 7B is the outline of the glyph in FIG. 7A.
Figure 7A:
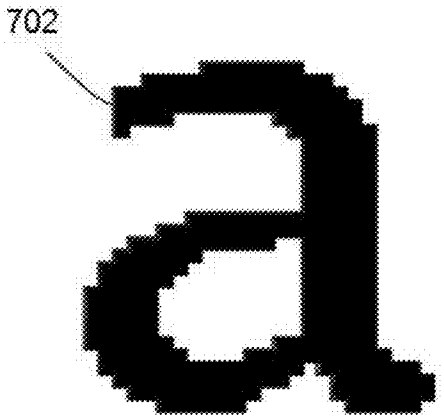
FIG. 7A is an example pixelated glyph.

FIG. 7A shows an example pixelated text element 702 that may be displayed on an electro-optic display. The outline of text element 702 is shown by 704 in FIG. 7B. In order to change the letter "a" to another glyph, some pixels within region 704 may need to be changed to another pixel value. A mask may be used to update region 704 and some adjacent pixels. FIGS. 8A-G are example masks that may be applied when updating the text element 702 to another glyph. The masks include the pixels of text element 702, and additional pixels falling within the convex hull of the pixels of text element 702. The masks may include additional pixels to reduce the number of edges and/or length of all edges to reduce the rate of edge accumulation.

As an example, mask 802 in FIG. 8A includes the pixels in glyph 702 and region 804, forming a closed glyph of the pixelated letter where the glyph has no holes. In another example, mask 806 in FIG. 8B includes additional pixel regions 808 and 810. Region 810 in FIG. 8B is an example where the number of edges may be reduced by updating the additional pixels in region 810 and may reduce edge artifacts due to ghosting by including region 810 in the mask. An additional example of a mask for updating pixelated glyph 702 may include 811 in FIG. 8C which includes the pixels of 704 as well as region 810 and region 812 and, likewise, is a reduction of edge length. Another example is mask 814 in FIG. 8D, which includes the pixels of 704 as well as regions 810, 812, 816, and 818. The inclusion of regions 816 and 818 may reduce artifacts due to corners. FIG. 8E is an example of a convex hull where all points are contained within the envelope 820. FIG. 8F is an example of a checkerboard pattern 832 within the convex hull 822, which includes regions 826 and 830, identifying selected updated areas and switching between the updated areas every other update, i.e., black areas 824 for the first update and white 828 for the next. Similar to FIG. 8F, FIG. 8G is an example of a checkerboard pattern 830 that overlays the glyph 828 to identify areas that are updated when removing, i.e., white 832 for the first update and black 834 for the next, then white, then black, etc. The update may be sequential or it may be ordered such as black, black, white, white, or in any order where the area is updated regularly to prevent edge ghosting. The white checkerboard indicates areas that are updated during a first update while the black checkerboard indicates areas that are updated during a second update. The black and white squares in the checkerboard may be assigned to display a complete board or a partial board, or a may be randomly assigned.

Thus, it should be appreciated that the particular mask chosen for a given update may be selected based on the number of edges and/or corners in the mask and the total number of pixels being updated by application of the mask. In this manner, artifacts (e.g., edge artifacts) may be minimized without an unacceptable increase in flashiness.

Having thus described several aspects and embodiments of the technology of this application, it is to be appreciated that various alterations, modifications, and improvements will readily occur to those of ordinary skill in the art. Such alterations, modifications, and improvements are intended to be within the spirit and scope of the technology described in the application. For example, those of ordinary skill in the art will readily envision a variety of other means and/or structures for performing the function and/or obtaining the results and/or one or more of the advantages described herein, and each of such variations and/or modifications is deemed to be within the scope of the embodiments described herein. Those skilled in the art will recognize, or be able to ascertain using no more than routine experimentation, many equivalents to the specific embodiments described herein. It is, therefore, to be understood that the foregoing embodiments are presented by way of example only and that, within the scope of the appended claims and equivalents thereto, inventive embodiments may be practiced otherwise than as specifically described. In addition, any combination of two or more features, systems, articles, materials, kits, and/or methods described herein, if such features, systems, articles, materials, kits, and/or methods are not mutually inconsistent, is included within the scope of the present disclosure.

What is claimed is:

1. A method for driving an electro-optic display, the method comprising:

displaying a glyph on a display at a first time, wherein the glyph includes a font using a font hint, wherein at the first time, the glyph is presented at a first bit depth; and displaying the same glyph at a second time on the display at a second bit depth, wherein the glyph presented at the second time includes the same font hint, wherein the first bit depth has fewer bits than the second bit depth, and wherein the time needed to display the glyph in the first bit depth is shorter than the time needed to display the glyph in the second bit depth.

2. The method of claim 1, wherein the first bit depth is 1-bit.

3. The method of claim 1, wherein the font hint is specific to the second bit depth.

* * * * *